US005889250A

United States Patent [19]

Castonguay

[11] Patent Number: 5,889,250

[45] Date of Patent: Mar. 30, 1999

[54] CIRCUIT BREAKER CLOSING SPRINGS BUTTON INTERLOCK MECHANISM

[75] Inventor: Roger N. Castonguay, Terryville, Conn.

[73] Assignee: General Electric Company, New York, N.Y.

[21] Appl. No.: 878,597

[22] Filed: Jun. 19, 1997

[51] Int. Cl.[6] ..... H01H 3/00; H01H 31/00; H01H 5/00

[52] U.S. Cl. ..... 218/154; 200/400; 200/50.01

[58] Field of Search ..... 200/400, 323, 200/327, 50.01; 218/154

[56] References Cited

U.S. PATENT DOCUMENTS 4,167,988 9/1979 Acampora et al. ..... 185/40 R 5,495,082 2/1996 Zaffetti et al. ..... 200/400

*Primary Examiner*—Renee S. Luebke
*Assistant Examiner*—Michael J. Hayes
*Attorney, Agent, or Firm*—Richard A. Menelly; Carl B. Horton

[57] ABSTRACT

An air circuit breaker ratcheting mechanism includes a ratchet and pawl whereby the closing springs charging gear is prevented from reverse rotation during the closing springs charging operation. Upon completion of the charging operation, the ratchet and pawl become disengaged from the charging gear when the charged closing springs are released in response to a manual closing button depression. An interlock arrangement prevents release of the holding prop to discharge the charged circuit breaker closing springs unless the circuit breaker operating handle is completely in the home position.

14 Claims, 5 Drawing Sheets

CIRCUIT BREAKER CLOSING SPRINGS BUTTON INTERLOCK MECHANISM

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

As described within the aforementioned U.S. Pat. No. 4,167,988, the ratchet mechanism includes a driving pawl coupled with the motor operator for incrementally advancing a ratchet wheel coupled with the circuit breaker operating mechanism. Each incremental advance of the ratchet wheel is sustained by a holding pawl. Ultimately, the ratchet wheel is advanced to an angular position where the circuit breaker closing springs are fully charged and therefore empowered to forcibly close the circuit breaker contacts. Typically, the discharge of the closing springs rapidly drives the ratchet wheel in the same direction as did the driving pawl in charging the closing springs. In the process, the teeth on the ratchet wheel impact with the driving and holding pawls, producing undue pawl and ratchet wear, as well as unnecessary stress on the pawl springs and mountings. Moreover, when the breaker contacts close, there is an inevitable rebound which tends to rotate the holding pawl. Under these circumstances, the straight sides of the ratchet teeth impact against the straight edges of the pawl tips, causing potentially damaging stresses in the ratcheting mechanism. The patent further suggests the use of a holding prop to hold the pawls out of engagement with the ratchet wheel until the closing springs have fully discharged to protect the pawls and the ratchet wheel from potential damage. When the contacts have become closed, the circuit breaker operating mechanism components are exposed to allow an operator to manually release the holding prop in order for the holding pawl to again become operative in recharging the circuit breaker closing spring.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker".

When the circuit breaker closing springs are completely charged, the holding pawl is removed from the charging gear to allow the charging shaft to rotate when the circuit breaker closing button is activated, as described in U.S. patent application Ser. No. 08/863,649 entitled "Ratcheting Mechanism for an Industrial-Rated Circuit Breaker", filed 27 May 1997. With the holding pawl removed from the charging gear, the closing springs exert a force of rotation on the charging shaft and some means must be employed to assure that the charging shaft remains in a closing springs "charged condition" until and unless the circuit breaker closing button is activated, as described in U.S. patent application Ser. No. 08/865,165 entitled "Closing Springs Release Mechanism for Industrial-Rated Circuit Breaker", filed 28 May 1997.

When the circuit breaker closing springs are fully-charged, they are ordinarily released by means of a closing button arranged on the circuit breaker cover next to the circuit breaker operating handle. Should an operator attempt to depress the closing button while lifting the operating handle, the force exerted on the handle by means of the released closing springs could cause damage to the circuit breaker internal operating components.

One purpose of the invention is to interlock the circuit breaker operating handle with the circuit breaker closing button to prevent the circuit breaker closing springs from becoming closed unless the operating handle is completely in the home position.

SUMMARY OF THE INVENTION

An air circuit breaker ratcheting mechanism includes a ratchet and pawl whereby the closing springs charging gear is prevented from reverse rotation during the closing springs charging operation. Upon completion of the charging operation, the ratchet and pawl become disengaged from the charging gear when the charged closing springs are released in response to a manual closing button depression. A holding prop within the ratcheting mechanism interacts with a roller bearing on the charging shaft to prevent further rotation of the charging shaft under the bias provided by the charged closing springs. An interlock arrangement prevents release of the holding prop to discharge the charged circuit breaker closing springs unless the circuit breaker operating handle is completely in the home position.

DESCRIPTION OF THE PREFERRED EMBODIMENT

Figure 1:
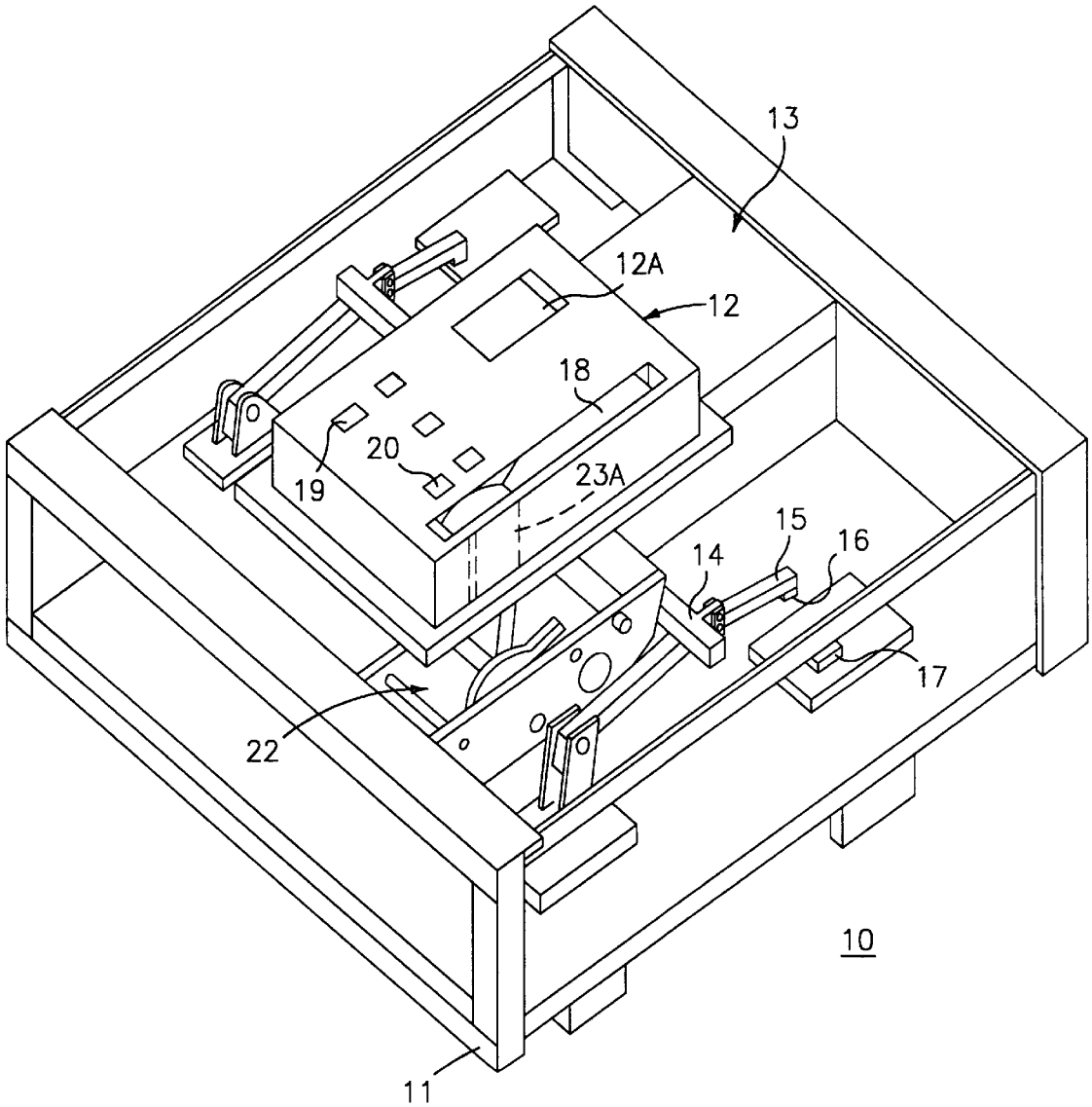
FIG. 1 top perspective view of an air circuit breaker containing a modular ratcheting mechanism that includes the circuit breaker closing button-operating handle interlock arrangement according to the invention.

The air circuit breaker 10 of FIG. 1 is similar to that described within the aforementioned U.S. Pat. No. 3,095,489 and includes a metal frame 11 which supports circuit breaker cover 12, the trip unit programmer 12 A and the operating mechanism enclosure 13. The trip unit programmer is similar to that described in U.S. Pat. No. 4,672,501 entitled "Circuit Breaker and Protective Relay Unit". The cover further includes a trip button 19 for releasing the circuit breaker operating mechanism contained within the enclosure 13 for separating the circuit breaker contacts 16, 17 to their open condition and a closing button 20 for moving the contacts to their closed position. The circuit breaker contact arms 15 within each pole of a three pole circuit arrangement, are interconnected by means of the operating mechanism crossbar 14 to insure that all contacts within the separate poles both open and close in unison. The ratcheting mechanism 22 improves over the earlier mechanism described in the aforementioned U.S. Pat. No. 3,729,065 by allowing the operating mechanism closing springs described therein to be charged remotely by means of a motor operator. The operating handle 18 interacts with the ratcheting mechanism 22 by means of a pair of plate connectors, one of which is indicated at 23A.

Figure 2:
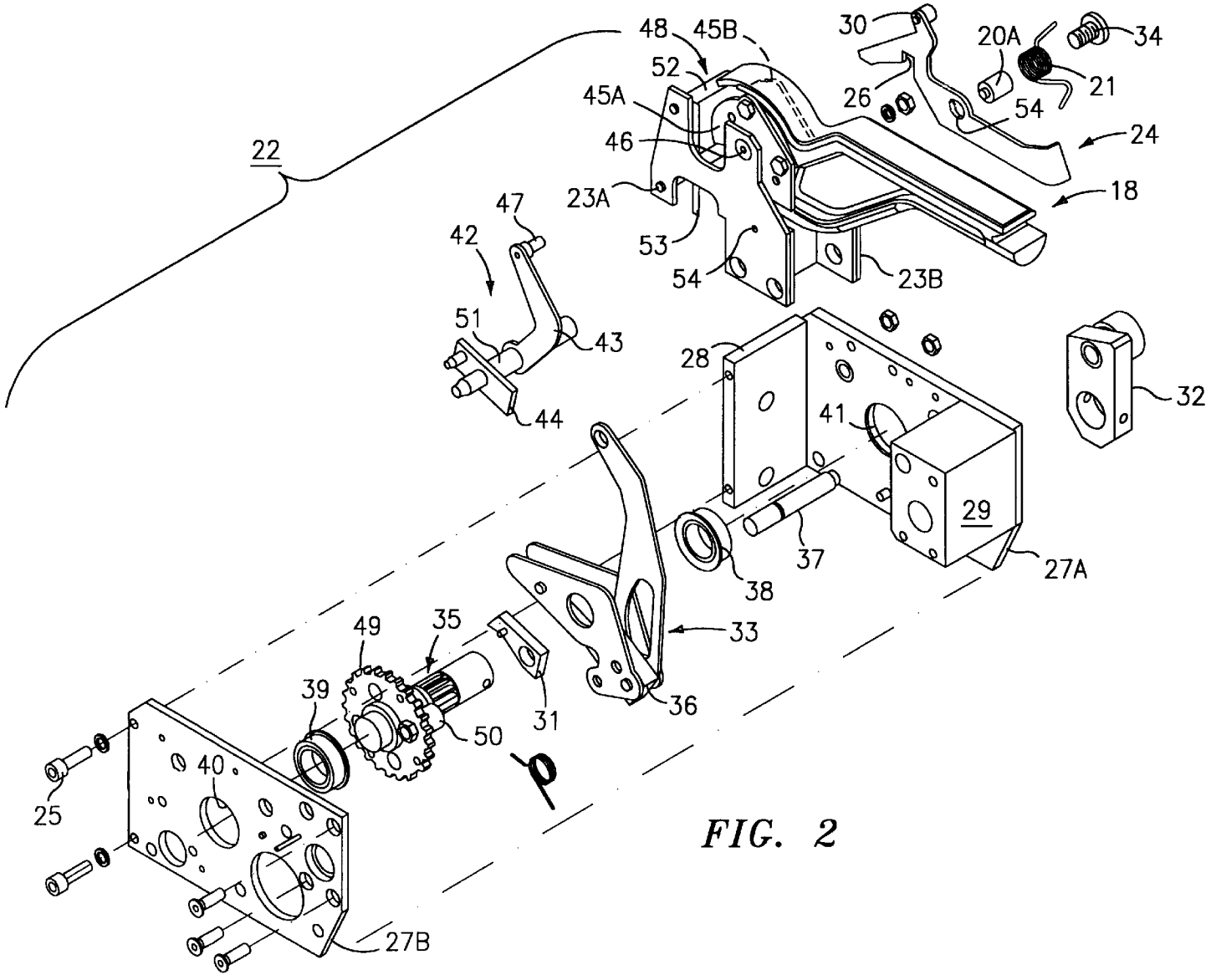
FIG. 2 is a top perspective view of the ratcheting mechanism of FIG. 1 with the components in isometric projection prior to assembly.
Figure 3:
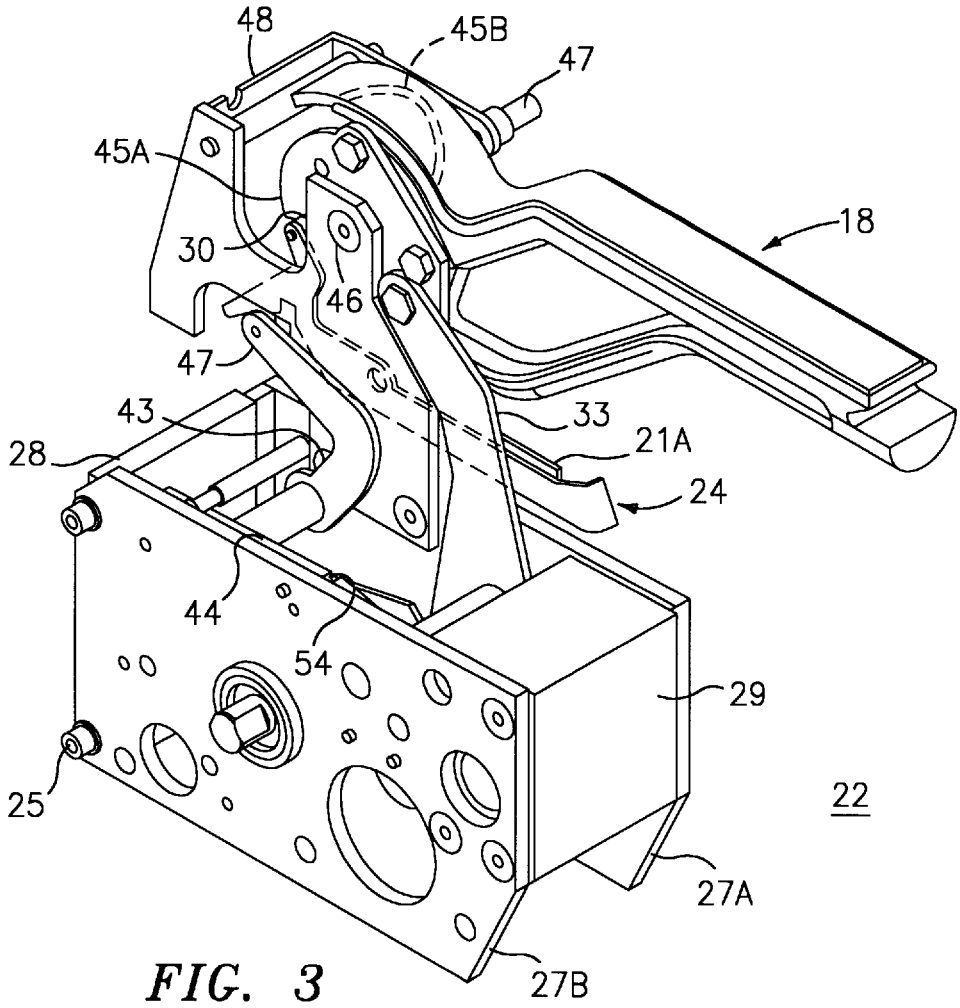
FIG. 3 is an enlarged top view of the modular ratcheting mechanism of FIG. 1 prior to attachment to the circuit breaker operating mechanism enclosure.

The operating handle 18 within the ratcheting mechanism 22 is shown in FIGS. 2 and 3 assembled onto a pair of camming plates 45A, 45B and attached to the ratchet mechanism sideframes 27A, 27B by the handle pivot 46. The ratchet mechanism sideframes are separated by means of block spacers 28, 29 which are connected to the sideframes by means of bolts 25. The charging crank 33 and intervening charging pawl 36 interact with the operating handle 18 in the manner described within the aforementioned U.S. patent application Ser. No. 08/863,649. The holding pawl 31 is connected within the side frames 27A, 27B by means of the ratchet pawl pivot pin 37 and flanges 38, 39 that extend through the openings 40, 41 formed within the sideframes 27B, 27A respectively. The holding pawl 31 interacts with the charging gear 49 to prevent reverse rotation of the charging shaft 35 during the charging of the circuit breaker closing springs (not shown) by means of the circuit breaker operating mechanism coupler 32 as described within the referenced U.S. Pat. No. 4,672,501. The bell crank 42 includes a lever arm 43 with a release pin 47 extending from one end and connects with a holding prop 44 by means of the pivot shaft 51 at the opposite end thereof. The pivot shaft 51 also serves to pivotally support the bell crank onto the ratcheting mechanism sideframes 27A, 27B. The roller bearing 50 extending from the charging gear 49 on the charging shaft 35 stops against the end of the holding prop to prevent rotation of the charging shaft after the closing springs are fully charged. To later allow the rotation of the charging shaft to release the circuit breaker closing springs, the release lever 48 which pivotally attaches to the top of the connector plate 23A by means of the pivot post 52 is employed. The release lever is described in the aforementioned U.S. patent application Ser. No. 08/864,165. A release pin 47 extends outwards from the lever arm 43 and is trapped behind the release tab 53 extending from the bottom of the release lever 48 and is removed therefrom to allow the closing springs to release upon depression of the closing button 20 of FIG. 1. This occurs only if the operating handle 18 is in its inactive or "home"=0 position. The interlock link 24 of the invention insures that the closing button 20 (FIG. 1) cannot be depressed by interacting with the release pin 47 in the manner to be described below. The interlock link 24 includes a torsion spring 21 that is positioned on the side of the link by the support post 20A which carries the torsion spring 21. The interlock link 24 is then attached to the side frame 23B by means of the screw 34 and aperture 54. The interaction between the interlock link 24 and the operating handle 18 by means of the holding slot 26 and cam pin 30 within the ratcheting mechanism 22 is best seen by now referring to FIGS. 4 and 5.

Figure 4:
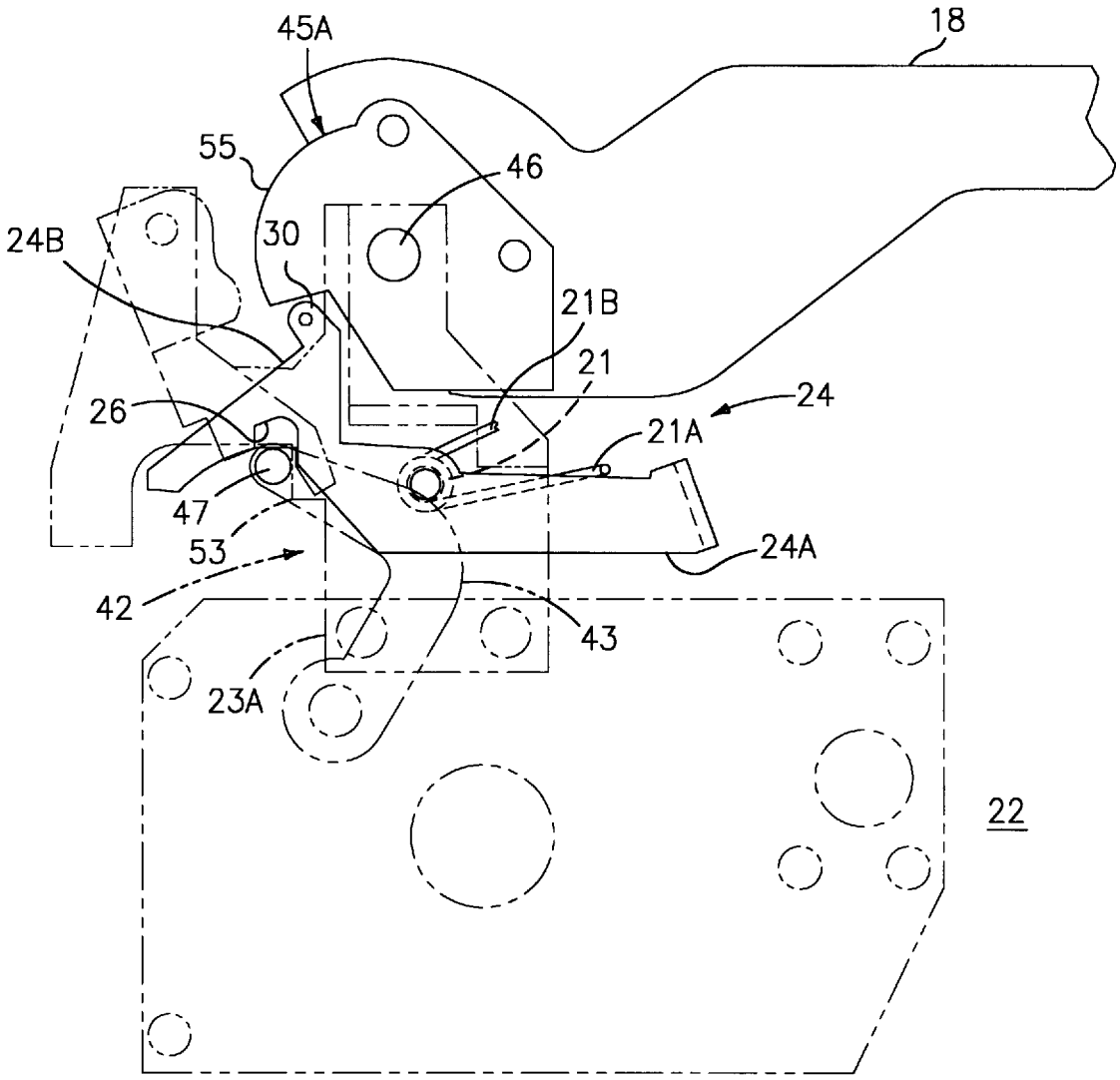
FIG. 4 is an enlarged side view of a part of the ratcheting mechanism of FIG. 3 with the circuit breaker operating handle in a home position.

With the operating handle 18 in the home position about the handle pivot 46, as depicted in FIG. 4, the torsion spring 21 connecting with the leg 24A of the interlock link 24 at one end as indicated at 21 A and with the connector plate 23A at the opposite end as indicated at 21B is biased in the clockwise direction whereby the holding slot 26 is away from the release pin 47 on lever arm 43 within the bell crank 42 such that the release tab 53 can readily rotate the release pin when the closing button 20 (FIG. 1) is depressed to release the closing springs as described in the aforementioned U.S. patent application Docket No. 41PR-7415. The cam pin 30 extending from the front 24B is away from the camming surface 55 formed on the surface of the cam plate 45A.

Figure 5:
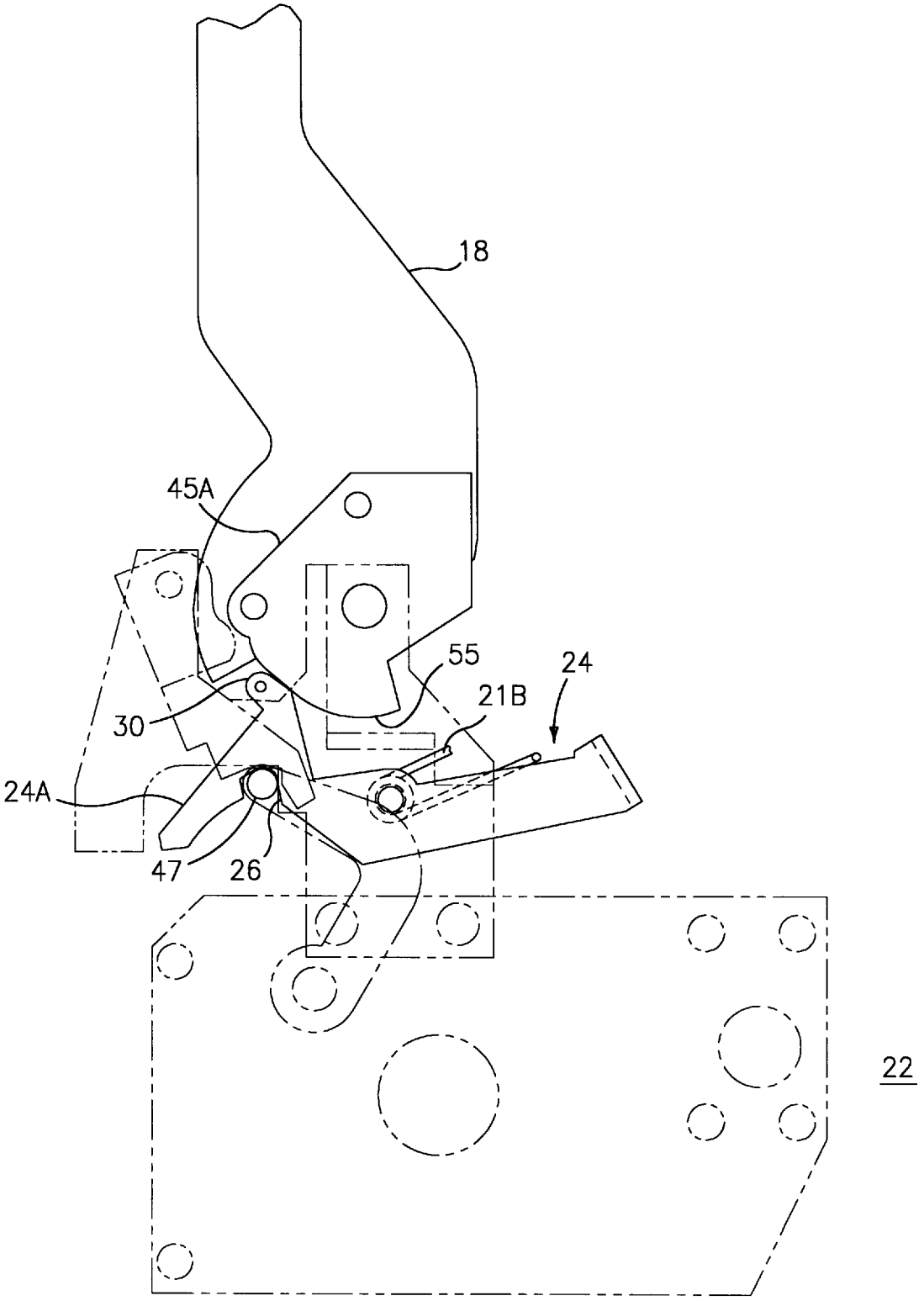
FIG. 5 is an enlarged side view of a part of the ratcheting mechanism of FIG. 3 with the circuit breaker operating handle in a operative position.

With the operating handle 18 on the ratcheting mechanism 22 rotated in the counter-clockwise direction indicated in FIG. 5, the camming surface 55 on the cam plate 45A strikes against the cam pin 30 driving the leg 24A of the interlock link 24 counter-clockwise and capturing the release pin 47 within the holding slot 26. When an attempt is now made to release the circuit breaker closing springs by depression of the close button 20 of FIG. 1, the release pin 47 remains trapped within the holding slot 26 until the operating handle 18 is returned to the inactive home position shown earlier in FIG. 4. The torsion spring 21 then rotates the interlock link 24 in the clockwise direction to return the interlock link to the position shown in FIG. 4 with the release pin out from the holding slot and free to release the closing springs when the close button is depressed.

I claim:

1. A circuit breaker operating handle interlock comprising:

a pair of opposing sideframes;

a charging pawl within said sideframes and arranged for interacting with a circuit breaker closing springs charging shaft;

an operating handle extending above said sideframes and including a pair of opposing cam plates, one on each side thereof;

a charging link connecting between said operating handle and said charging pawl for transfer of charging force from said operating handle to said charging pawl;

a holding pawl engaged with said charging shaft to prevent reverse rotation of said charging shaft when said charging force is applied thereto;

a bell crank and a release lever, said bell crank including a holding prop extending therefrom for contacting a roller bearing on said charging shaft;

a release tab extending from a bottom of said release lever and a release pin extending from a top of said bell crank to release said holding prop from said roller; and means within said sideframes for preventing said release lever from removal of said holding prop from said roller bearing when said operating handle is in a first position and allowing said release lever to release said holding prop when said operating handle is in a second position.

2. The interlock of claim 1 wherein said means within said sideframes for preventing release of said release lever comprises an interlock link.

3. The interlock of claim 2 wherein said interlock link defines a first end having a holding slot formed on a bottom thereof and arranged for trapping said release pin and thereby prevent translation of said release pin from said holding slot.

4. The interlock of claim 3 wherein said interlock link includes a torsion spring arranged for biasing said holding slot away from said release pin.

5. The interlock of claim 4 wherein said interlock link includes a cam pin extending from a top of said first end and one of said cam plates includes a camming surface.

6. The interlock of claim 5 wherein said camming surface is away from said cam pin when said operating handle is in said second position and wherein said camming surface abuts said cam pin when said operating handle is in said first position.

7. The interlock of claim 4 wherein said torsion spring connects between said interlock link and said one cam plate.

8. A circuit breaker comprising:

a support frame;

an operating mechanism within said support frame, said operating mechanism including a contact closing spring;

a moveable contact arm interacting with said contact closing spring for opening and closing a pair of contacts;

a trip unit interacting with said operating mechanism for articulating said operating mechanism to separate said contacts upon command;

a pair of opposing sideframes;

a charging pawl within said sideframes and arranged for interacting with a circuit breaker closing springs charging shaft;

an operating handle extending above said sideframes and including a pair of opposing cam plates, one on each side thereof;

a charging link connecting between said operating handle and said charging pawl for transfer of charging force from said operating handle to said charging pawl;

a holding pawl engaged with said charging shaft to prevent reverse rotation of said charging shaft when said charging force is applied thereto;

a bell crank and a release lever, said bell crank including a holding prop extending therefrom for contacting a roller bearing on said charging shaft;

a release tab extending from a bottom of said release lever and a release pin extending from a top of said bell crank to release said holding prop from said roller; and means within said sideframes for preventing said release lever from removal of said holding prop from said roller when said operating handle is in a first position and allowing said release lever to release said holding prop when said operating handle is in a second position.

9. The circuit breaker of claim 8 wherein said means within said sideframes for preventing release of said release lever comprises an interlock link.

10. The circuit breaker of claim 9 wherein said interlock link defines a first end having a holding slot formed on a bottom thereof and arranged for trapping said release pin and thereby prevent translation of said release pin from said holding slot.

11. The circuit breaker of claim 10 wherein said interlock link includes a torsion spring arranged for biasing said holding slot away from said release pin.

12. The circuit breaker of claim 11 wherein said interlock link includes a cam pin extending from a top of said first end and one of said cam plates includes a camming surface.

13. The circuit breaker of claim 12 wherein said camming surface is away from said cam pin when said operating handle is in said second position and wherein said camming surface abuts said cam pin when said operating handle is in said first position.

14. The circuit breaker of claim 11 wherein said torsion spring connects between said interlock link and one of said cam plates.

* * * * *